US011419367B1

(12) United States Patent
Hogstad

(10) Patent No.: US 11,419,367 B1
(45) Date of Patent: Aug. 23, 2022

(54) HOLSTER

(71) Applicant: Pamela Jane Hogstad, Fargo, ND (US)

(72) Inventor: Pamela Jane Hogstad, Fargo, ND (US)

( * ) Notice: Subject to any disclaimer, the term of this patent is extended or adjusted under 35 U.S.C. 154(b) by 0 days.

(21) Appl. No.: 17/245,755

(22) Filed: Apr. 30, 2021

Related U.S. Application Data

(60) Provisional application No. 63/018,166, filed on Apr. 30, 2020.

(51) Int. Cl.
*F41C 33/02* (2006.01)
*A41C 3/00* (2006.01)
*F41C 33/04* (2006.01)

(52) U.S. Cl.
CPC ..... *A41C 3/005* (2013.01); *F41C 33/0209* (2013.01); *F41C 33/048* (2013.01)

(58) Field of Classification Search
CPC .... A41C 3/005; F41C 33/0209; F41C 33/041; F41C 33/046; F41C 33/048
See application file for complete search history.

(56) References Cited

U.S. PATENT DOCUMENTS 3,003,670 A * 10/1961 Stella ..... F41C 33/0209 224/192
4,258,871 A * 3/1981 McMahon ..... F41C 33/046 224/192
2012/0187164 A1* 7/2012 Looper ..... F41C 33/048 224/243
2014/0131410 A1* 5/2014 Looper ..... F41C 33/041 224/587
2014/0374452 A1* 12/2014 Hammers ..... F41C 33/048 224/243
2016/0265875 A1* 9/2016 Malcolm ..... F41C 33/048

* cited by examiner

*Primary Examiner* — Corey N Skurdal

(57) ABSTRACT

A holster is configured to assist a user in concealing a firearm. The holster has a front panel, joined to a back panel. A short back strap is joined to the back panel. An elastic material is joined to the front panel. A trim seals three edges of the front panel and the back panel. A long strap is joined to the front panel. The long strap is fastened to the short back strap forming a loop. A belt is sewn over the top of the elastic of the front panel and configured to wrap around a human user.

5 Claims, 5 Drawing Sheets

HOLSTER

RELATED APPLICATION

This application claims priority to provisional patent application U.S. Ser. No. 63/018,166 filed on Apr. 30, 2020, the entire contents of which is herein incorporated by reference.

BACKGROUND

The embodiments herein relate generally to clothing and personal accessories.

Prior to embodiments of the disclosed invention, there was no good option for women who want to conceal carry and were concerned about concealment, comfort and accessibility of a pistol. Embodiments of the disclosed invention solve this problem.

SUMMARY

A holster is configured to assist a user in concealing a firearm. The holster has a front panel, joined to a back panel. A short back strap is joined to the back panel. An elastic material is joined to the front panel. A trim seals three edges of the front panel and the back panel. A long strap is joined to the front panel. The long strap is fastened to the short back strap forming a loop. A belt is sewn to the front panel over the elastic and configured to wrap around a human user.

In some embodiments, a bra has a gore and a wing. The gore or wing is arranged through the loop. The belt can further comprise a side release buckle, having a male end attached to a first end of the belt and a female end attached to a second end of the belt. An adjustment loop is arranged on the belt. The front panel, the back panel, the elastic material, and the trim are stitched together. A pistol can be arranged in a pocket between the belt, elastic material and the front panel.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
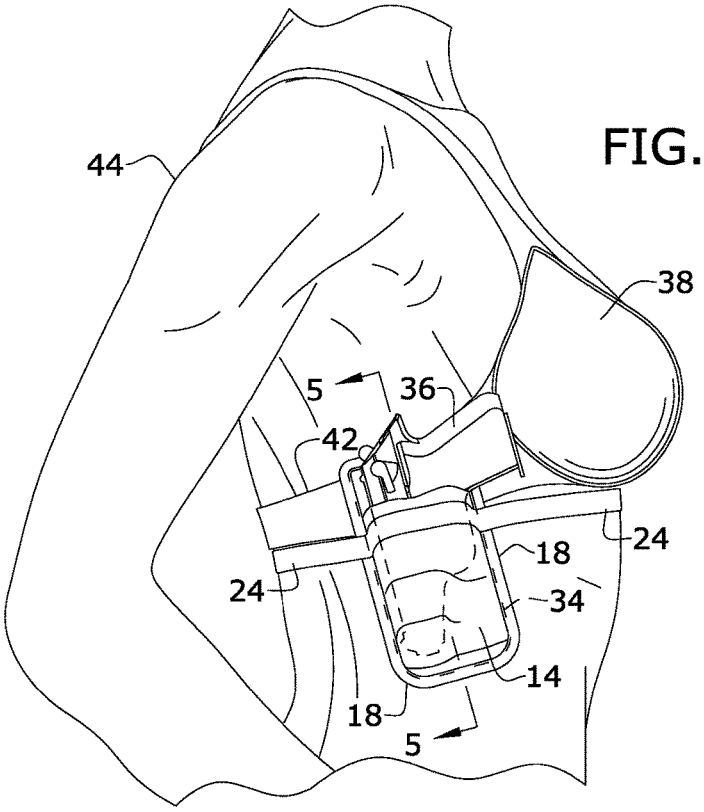
FIG. 1 shows a profile view of one embodiment of the present invention.
Figure 2:
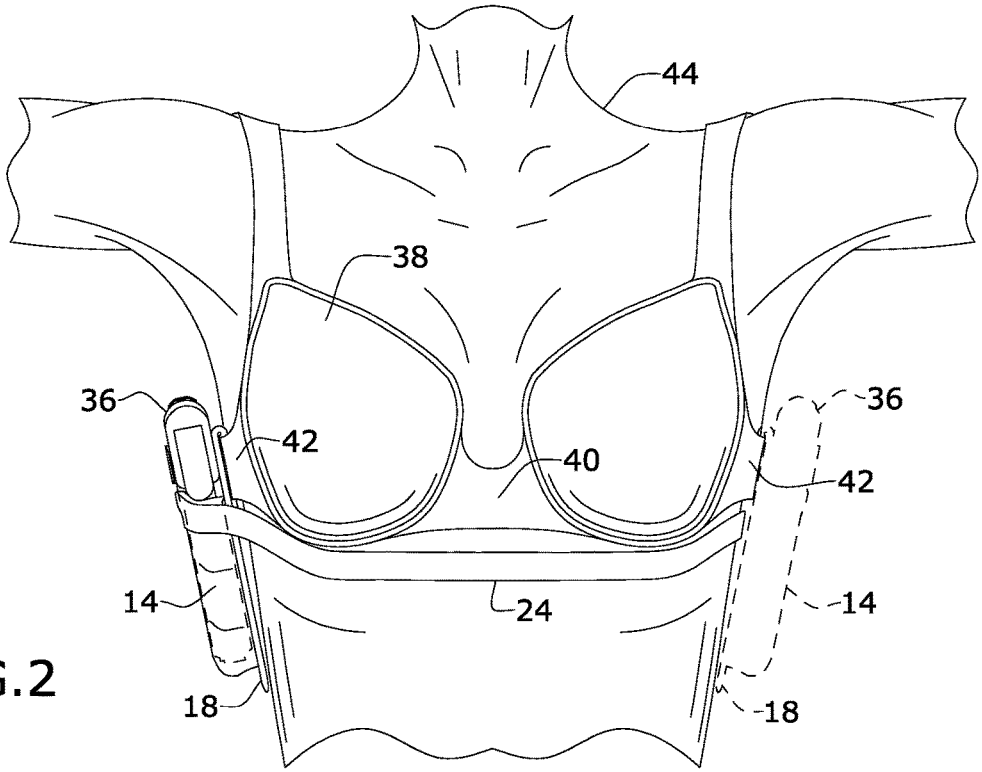
FIG. 2 shows a front view of one embodiment of the present invention.
Figure 3:
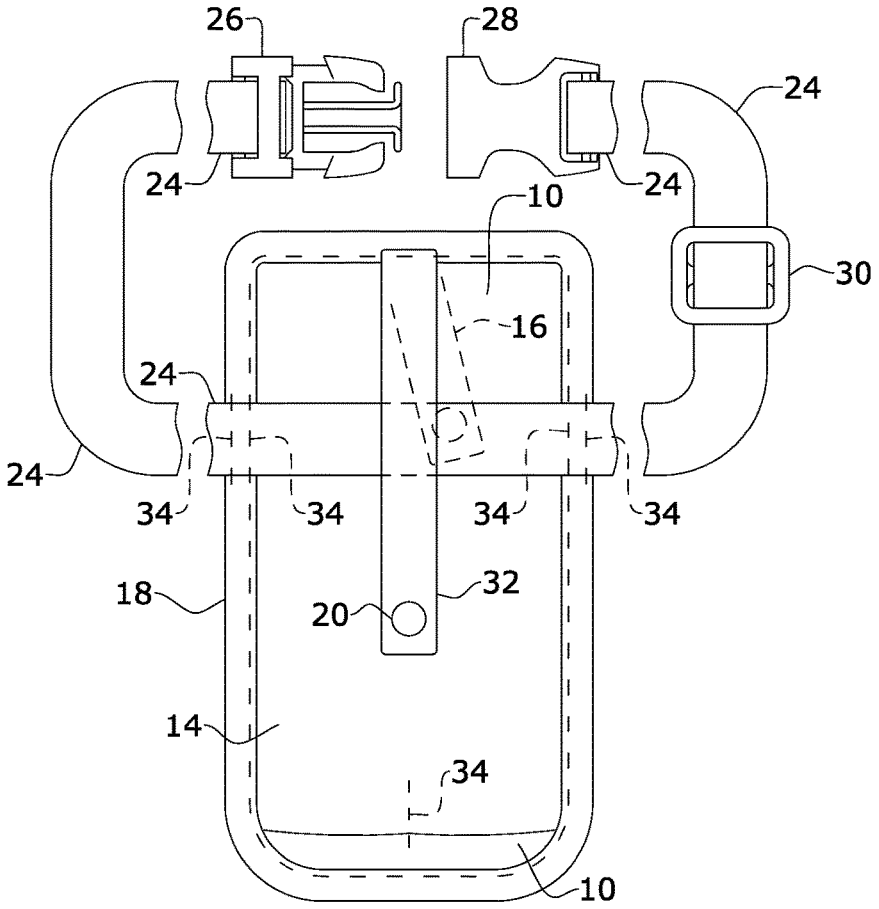
FIG. 3 shows a front view of one embodiment of the present invention.
Figure 4:
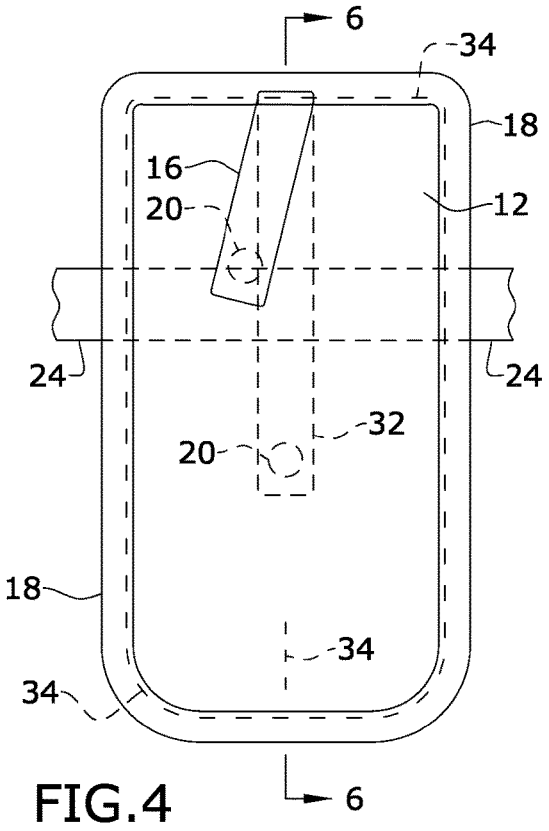
FIG. 4 shows a back view of one embodiment of the present invention.
Figure 5:
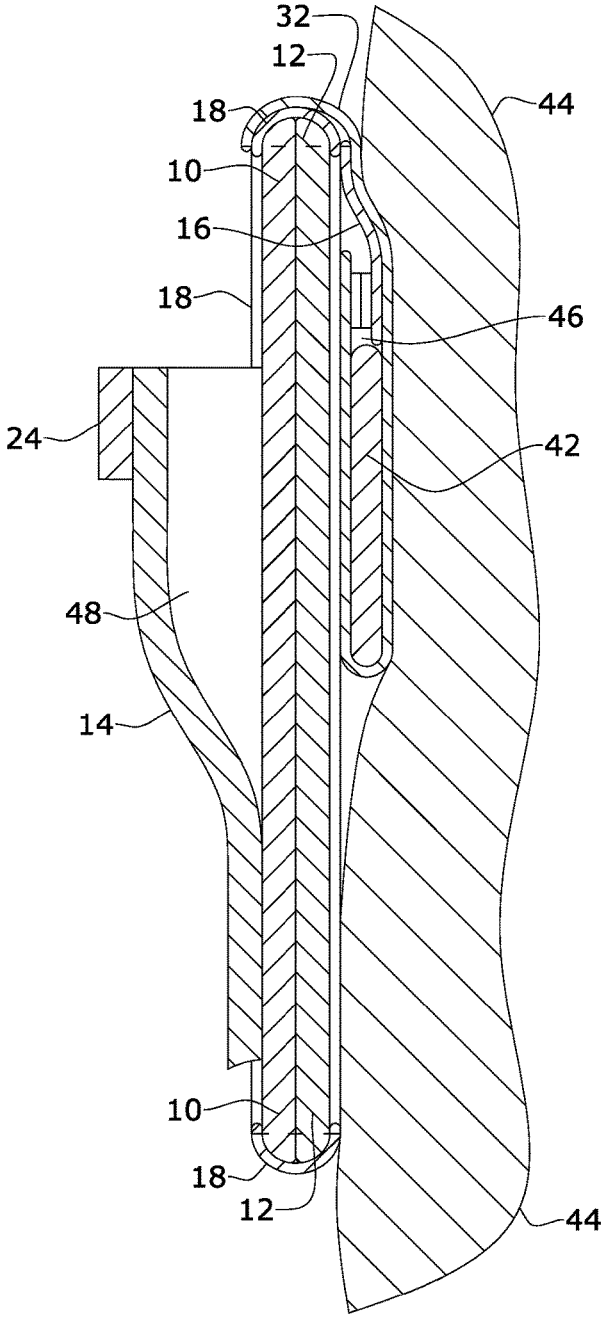
FIG. 5 shows a section view of one embodiment of the present invention taken along 5-5 FIG. 1.
Figure 6:
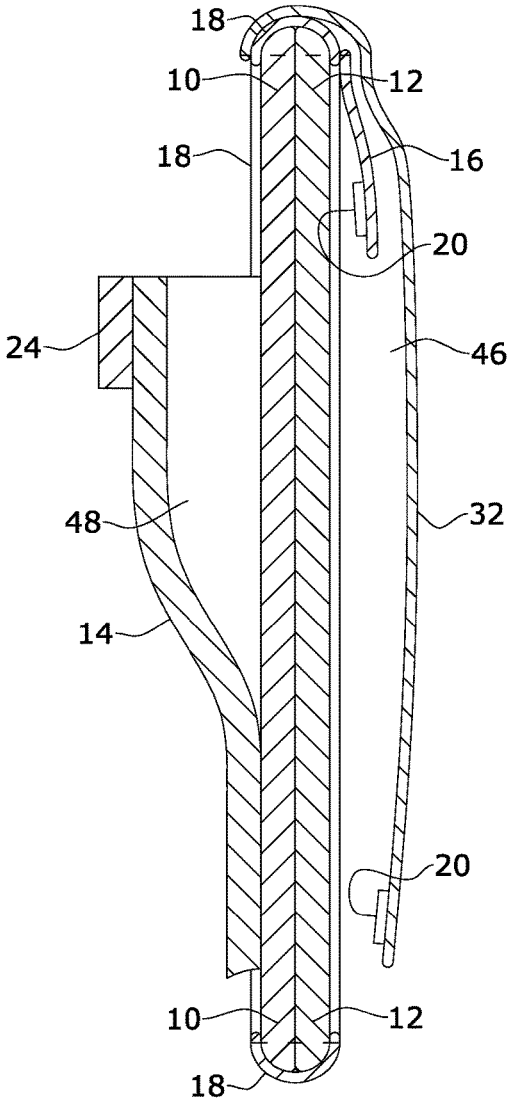
FIG. 6 shows a section view of one embodiment of the present invention taken along 6-6 FIG. 4.
Figure 7:
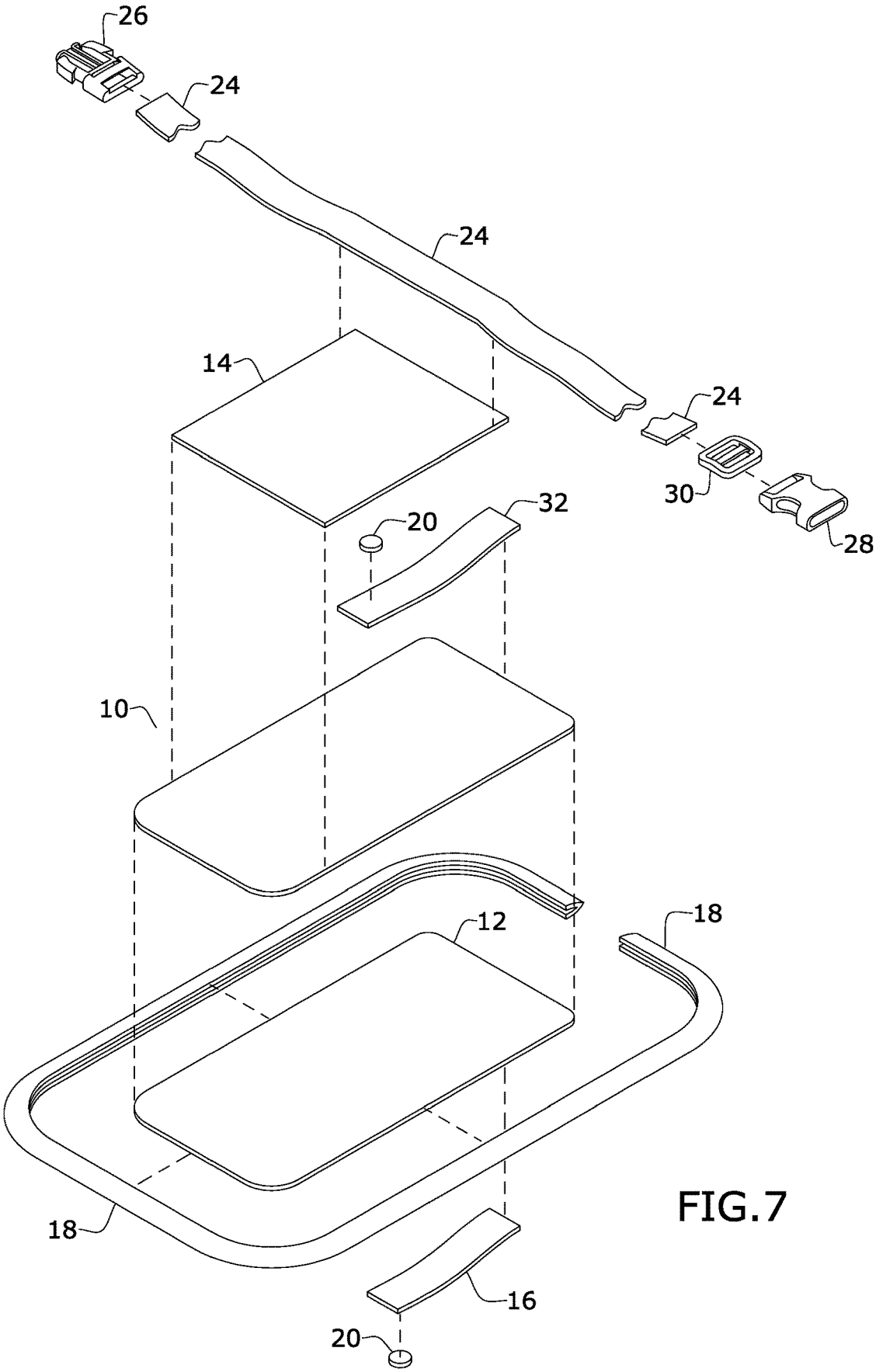
FIG. 7 shows an exploded view of one embodiment of the present invention.
Figure 8:
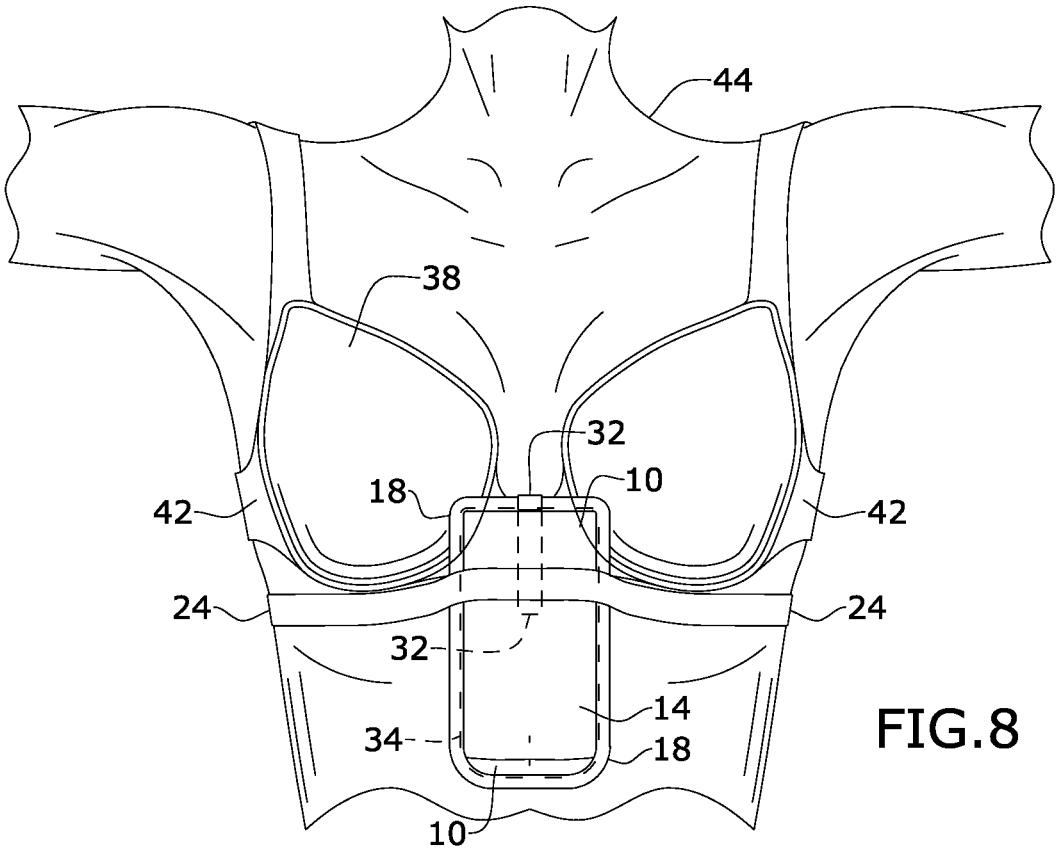
FIG. 8 shows a front view of one embodiment of the present invention.

By way of example, and referring to a holster is configured to assist a user in concealing a firearm 36. The holster has a front panel 10, joined to a back panel 12. A short back strap 16 is joined to the back panel 12. An elastic material 14 is joined to the front panel 10. A trim 18 seals three edges of the front panel 10 and the back panel 12. A long strap 32 is joined to the front panel 10. The long strap 32 is fastened to the short back strap 16 forming a loop 46. A belt 24 is sewn over the elastic 14 of the front panel 10, and configured to wrap around a human user 44.

In some embodiments, a bra 38 has a gore 40 and a wing 42. At least one of the gore 40, the left wing 42 and the right wing 42 is arranged through the loop. The user 44 can connect one to three holsters to this. The belt 24 can further comprise a side release buckle, having a male end 26 attached to a first end of the belt and a female end 28 attached to a second end of the belt. An adjustment loop 30 is arranged on the belt. The front panel 10, the back panel 12, the elastic material 14, and the trim 18 are stitched together with stitching 34. A pistol can 36 be arranged in a pocket 48 between the belt 24 elastic material 14 and the front panel 10.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 116. In particular, any use of "step of" in the claims is not intended to invoke the provision of 35 U.S.C. § 112, ¶ 116.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A holster, configured to assist a user in concealing a firearm; the holster comprising:

a front panel, joined to a back panel;

a short back strap joined to the back panel;

an elastic material joined to the front panel;

a trim, sealing three edges of the front panel and the back panel;

a long strap, joined to the front panel; wherein the long strap is fastened to the short back strap forming a loop; and a belt, sewn over the elastic on the front panel, and configured to wrap around a human user.

2. The holster of claim 1, further comprising a bra having a gore and a wing wherein the gore or the wing is arranged through the loop.

3. The holster of claim 2, wherein the belt further comprises a side release buckle, having a male end attached to a first end of the belt and a female end attached to a second end of the belt; an adjustment loop is arranged on the belt.

4. The holster of claim 2, wherein the front panel, the back panel, the elastic material, belt and the trim are stitched together.

5. The holster of claim 2, further comprising a pistol arranged in a pocket between the belt, elastic material and the front panel.

* * * * *